US008292987B2

(12) United States Patent
Gonze et al.

(10) Patent No.: US 8,292,987 B2
(45) Date of Patent: Oct. 23, 2012

(54) INDUCTIVELY HEATED PARTICULATE MATTER FILTER REGENERATION CONTROL SYSTEM

(75) Inventors: Eugene V. Gonze, Pinckney, MI (US); Michael J. Paratore, Jr., Howell, MI (US); Kevin W. Kirby, Calabasas Hills, CA (US); Amanda Phelps, Malibu, CA (US); Daniel J. Gregoire, Thousand Oaks, CA (US)

(73) Assignee: GM Global Technology Operations LLC

( * ) Notice: Subject to any disclaimer, the term of this patent is extended or adjusted under 35 U.S.C. 154(b) by 390 days.

(21) Appl. No.: 12/209,298

(22) Filed: Sep. 12, 2008

(65) Prior Publication Data

US 2009/0074630 A1 Mar. 19, 2009

Related U.S. Application Data

(60) Provisional application No. 60/973,280, filed on Sep. 18, 2007.

(51) Int. Cl.
*B01D 46/46* (2006.01)

(52) U.S. Cl. ..... 95/1; 95/278; 55/282.3; 55/283; 55/523; 55/DIG. 10; 55/DIG. 30

(58) Field of Classification Search ..... 55/522–524, 55/282.3; 422/169–172, 177–182
See application file for complete search history.

(56) References Cited

U.S. PATENT DOCUMENTS

| | | | | |
|---|---|---|---|---|
| 3,275,428 | A * | 9/1966 | Siegmund | 65/393 |
| 3,581,489 | A * | 6/1971 | Camin et al. | 60/275 |
| 4,505,726 | A | 3/1985 | Takeuchi | |
| 4,516,993 | A | 5/1985 | Takeuchi | |
| 4,979,364 | A * | 12/1990 | Fleck | 60/274 |
| 5,180,559 | A * | 1/1993 | Ma | 422/168 |
| 5,569,455 | A * | 10/1996 | Fukui et al. | 422/174 |
| 5,656,048 | A * | 8/1997 | Smith et al. | 55/282 |
| 6,090,172 | A * | 7/2000 | Dementhon et al. | 55/282.3 |
| 6,540,816 | B2 * | 4/2003 | Allie et al. | 95/278 |
| 6,720,060 | B1 * | 4/2004 | Swars | 428/116 |
| 2004/0173090 | A1 * | 9/2004 | Kondou et al. | 95/1 |
| 2005/0262817 | A1 * | 12/2005 | Hatanaka | 55/282.3 |
| 2006/0101794 | A1 * | 5/2006 | Gregoire et al. | 55/282.3 |
| 2009/0084077 | A1 * | 4/2009 | Hatanaka | 55/282.3 |

FOREIGN PATENT DOCUMENTS

| | | | |
|---|---|---|---|
| EP | 0327653 | A1 | 8/1989 |
| JP | 5231133 | A | 9/1993 |
| JP | 06-081628 | | 3/1994 |

* cited by examiner

*Primary Examiner* — Duane Smith
*Assistant Examiner* — Amber Orlando

(57) ABSTRACT

A system includes a particulate matter (PM) filter with an upstream end for receiving exhaust gas, a downstream end and zones. The system also includes a heating element. A control module selectively activates the heating element to inductively heat one of the zones.

19 Claims, 5 Drawing Sheets

INDUCTIVELY HEATED PARTICULATE MATTER FILTER REGENERATION CONTROL SYSTEM

CROSS-REFERENCE TO RELATED APPLICATIONS

This application claims the benefit of U.S. Provisional Application No. 60/973,280, filed on Sep. 18, 2007. The disclosure of the above application is incorporated herein by reference.

STATEMENT OF GOVERNMENT RIGHTS

This disclosure was produced pursuant to U.S. Government Contract No. DE-FC-04-03 AL67635 with the Department of Energy (DoE). The U.S. Government has certain rights in this disclosure.

FIELD

The present disclosure relates to particulate matter (PM) filters, and more particularly to electrically heated PM filters.

BACKGROUND

The statements in this section merely provide background information related to the present disclosure and may not constitute prior art.

Engines such as diesel engines produce particulate matter (PM) that is filtered from exhaust gas by a PM filter. The PM filter is disposed in an exhaust system of the engine. The PM filter reduces emission of PM that is generated during combustion.

Over time, the PM filter becomes full. During regeneration, the PM may be burned within the PM filter. Regeneration may involve heating the PM filter to a combustion temperature of the PM. There are various ways to perform regeneration including modifying engine management, using a fuel burner, using a catalytic oxidizer to increase the exhaust temperature with after injection of fuel, using resistive heating coils, and/or using microwave energy. The resistive heating coils are typically arranged in contact with the PM filter to allow heating by both conduction and convection.

Diesel PM combusts when temperatures above a combustion temperature such as 600° C. are attained. The start of combustion causes a further increase in temperature. While spark-ignited engines typically have low oxygen levels in the exhaust gas stream, diesel engines have significantly higher oxygen levels. While the increased oxygen levels make fast regeneration of the PM filter possible, it may also pose some problems.

PM reduction systems that use fuel tend to decrease fuel economy. For example, many fuel-based PM reduction systems decrease fuel economy by 5%. Electrically heated PM reduction systems reduce fuel economy by a negligible amount. However, durability of the electrically heated PM reduction systems has been difficult to achieve.

SUMMARY

A system is provided and includes a particulate matter (PM) filter with an upstream end for receiving exhaust gas, a downstream end and zones. The system also includes a heating element. A control module selectively activates the heating element to inductively heat one of the zones.

A method is provided that includes receiving an exhaust gas via a particulate matter (PM) filter that has an upstream end, a downstream end and zones. A heating element is selectively activated to inductively heat one of the zones.

A system is provided and includes heating elements that are in communication with a particulate matter filter that receives an exhaust gas. A control module selectively activates one of the heating elements to inductively heat a zone of the particulate matter filter.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
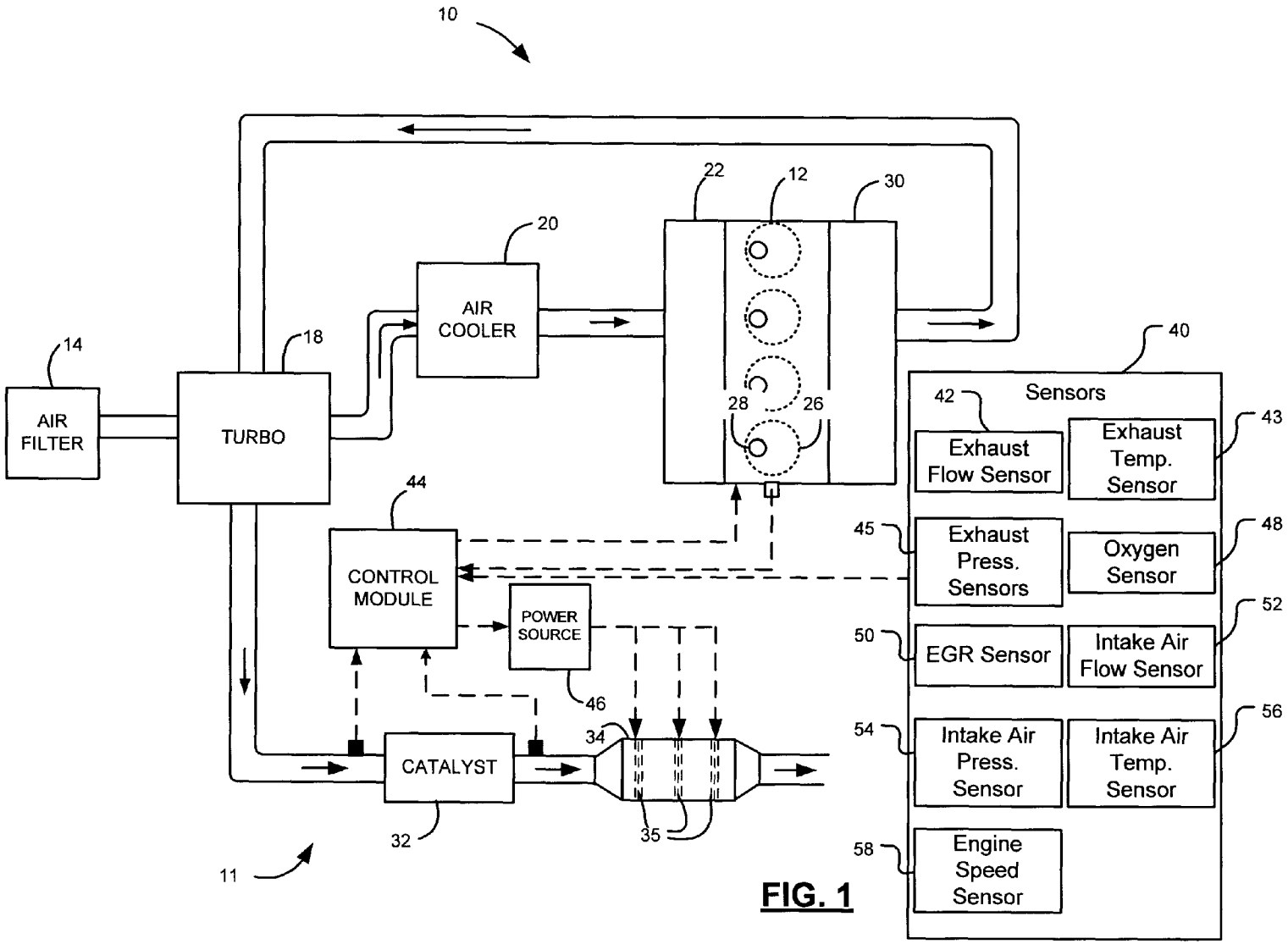
FIG. 1 is a functional block diagram of an exemplary engine system including a zoned particulate matter (PM) filter assembly with respective inductive heating elements in accordance with an embodiment of the present disclosure.

The following description is merely exemplary in nature and is not intended to limit the present disclosure, application, or uses. It should be understood that throughout the drawings, corresponding reference numerals indicate like or corresponding parts and features.

As used herein, the term module may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

Referring now to FIG. 1, an exemplary diesel engine system 10 that includes a regeneration system 11 is shown. It is appreciated that the diesel engine system 10 is merely exemplary in nature and that the regeneration system 11 described herein can be implemented in various engine systems implementing a zone heated particulate filter. Such engine systems may include, but are not limited to, gasoline direct injection engine systems and homogeneous charge compression ignition engine systems. For ease of the discussion, the disclosure will be discussed in the context of a diesel engine system.

A turbocharged diesel engine system 10 includes an engine 12 that combusts an air and fuel mixture to produce drive torque. Air enters the system by passing through an air filter 14. Air passes through the air filter 14 and is drawn into a turbocharger 18. The turbocharger 18 compresses the fresh air entering the system 10. The greater the compression of the air generally, the greater the output of the engine 12. Compressed air then passes through an air cooler 20 before entering into an intake manifold 22.

Air within the intake manifold 22 is distributed into cylinders 26. Although four cylinders 26 are illustrated, the systems and methods of the present disclosure can be implemented in engines having any number of cylinders. It is also appreciated that the systems and methods of the present disclosure can be implemented in a V-type cylinder configuration. Fuel is injected into the cylinders 26 by fuel injectors 28. Heat from the compressed air ignites the air/fuel mixture. Combustion of the air/fuel mixture creates exhaust. Exhaust exits the cylinders 26 into the exhaust system.

The exhaust system includes an exhaust manifold 30, a diesel oxidation catalyst (DOC) 32, and a particulate matter (PM) filter assembly 34 with heating elements 35 for zoned heating of the PM filter. Optionally, an EGR valve (not shown) re-circulates a portion of the exhaust back into the intake manifold 22. The remainder of the exhaust is directed into the turbocharger 18 to drive a turbine. The turbine facilitates the compression of the fresh air received from the air filter 14. Exhaust flows from the turbocharger 18 through the DOC 32 and into the PM filter assembly 34. The DOC 32 oxidizes the exhaust based on the post combustion air/fuel ratio. The amount of oxidation increases the temperature of the exhaust. The PM filter assembly 34 receives exhaust from the DOC 32 and filters any soot particulates present in the exhaust. The heating elements 35 heat the soot to a regeneration temperature as will be described below.

A control module 44 controls the engine and PM filter regeneration based on various sensed information and soot loading. More specifically, the control module 44 estimates loading of the PM filter assembly 34. When the estimated loading is at a predetermined level and/or the exhaust flow rate is within a desired range, current is controlled to the PM filter assembly 34 via a power source 46 to initiate the regeneration process. The duration of the regeneration process may be varied based upon the estimated amount of particulate matter within the PM filter assembly 34, the number of zones, etc.

Current is applied to one or more of the heating elements 35 during the regeneration process to inductively heat soot within the PM filter. The current has a frequency that is effective for heating small particles, such as soot or PM. The frequency may be approximately between 50-450 KHz. More specifically, inductive energy heats soot in selected zones of the PM filter assembly 34 for predetermined periods, respectively. Soot in the activated zones is heated to a point of ignition. The ignition of the soot heats the exhaust gas and creates an exotherm. The exotherm propagates along the PM filter and heats soot downstream from the heated zone.

In one embodiment, the regeneration process is divided up into regeneration periods. Each period is associated with the regeneration within an axial or radial portion of the PM filter. As an example, the heating elements may be activated sequentially axially from the output (downstream end) of the PM filter to the input (upstream end). The duration or length of each period may vary. The activation of a heating element heats soot in an area of a zone. The remainder of the regeneration process associated with that regeneration period is achieved using the heat generated by the heated soot and by the heated exhaust passing through that area and thus involves convective heating. Non-regeneration periods or periods in which all of the heating elements are deactivated may exist between regeneration periods to allow cooling of the PM filter and thus reduction of internal pressures within the PM filter.

The above system may include sensors 40 for determining exhaust flow levels, exhaust temperature levels, exhaust pressure levels, oxygen levels, intake air flow rates, intake air pressure, intake air temperature, engine speed, EGR, etc. An exhaust flow sensor 42, an exhaust temperature sensor 43, exhaust pressure sensors 45, oxygen sensor 48, an EGR sensor 50, an intake air flow sensor 52, an intake air pressure sensor 54, an intake air temperature sensor 56, and an engine speed sensor 58 are shown.

Figure 2:
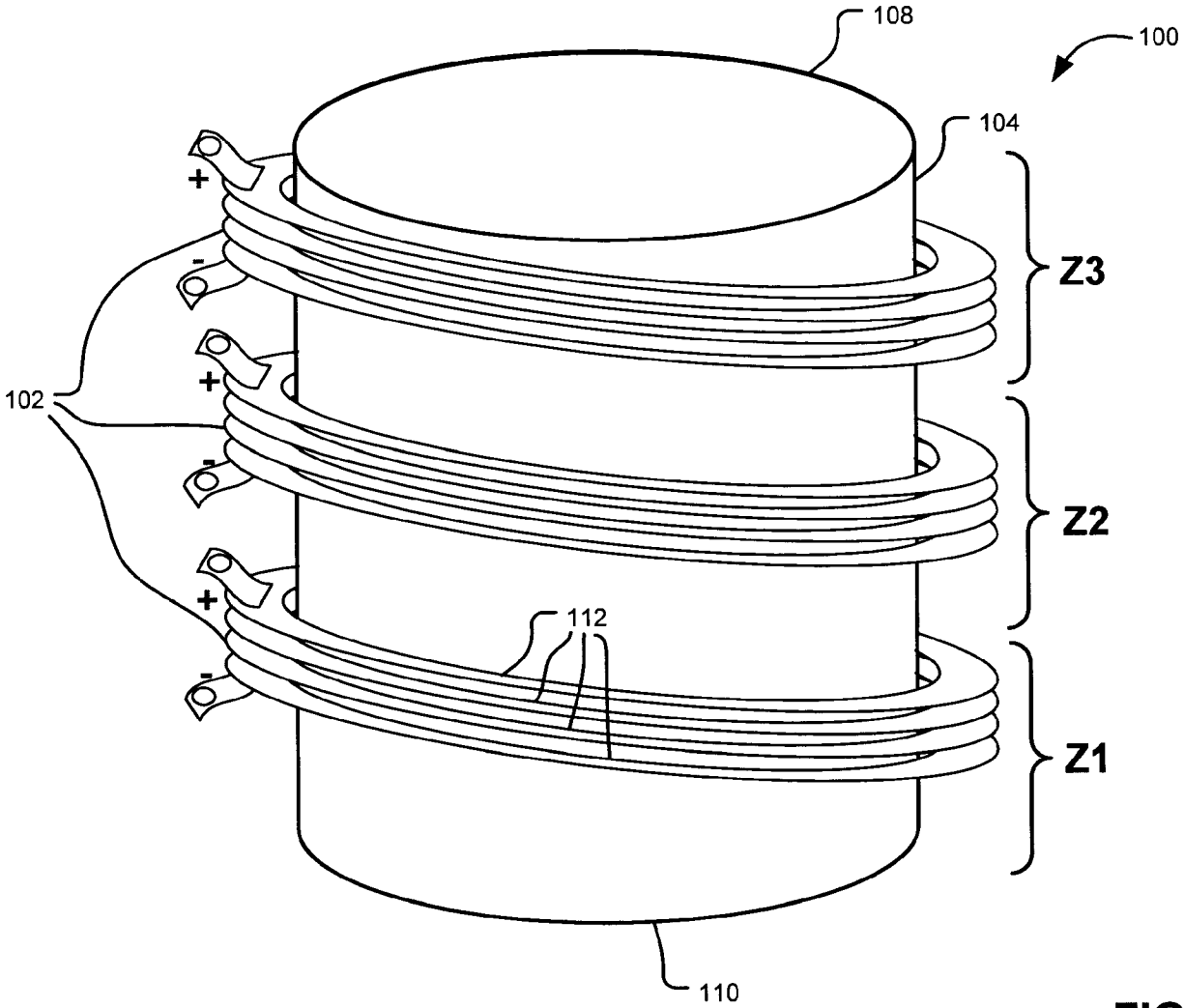
FIG. 2 is a perspective view of an exemplary zoned PM filter assembly with respective inductive heating elements in accordance with an embodiment of the present disclosure.

Referring now to FIG. 2, a perspective view of an exemplary zoned PM filter assembly 100 with respective inductive heating elements 102 is shown. The PM filter assembly 100 includes a PM filter 104 and the heating elements 102 attached thereon. In the embodiment shown, the heating elements 102 are in a parallel arrangement and positioned in series and axially along the PM filter 104 from an input 108 to an output 110 of the PM filter 104. The heating elements 102 may be electrically conductive and have any number of coils, such as the coils 112. The spacing of the coils and the spacing of the heating elements 102 may vary depending upon the application and the heating flexibility and control desired. Although three discrete heating elements 102 are shown, the number of heating elements may vary per application and the heating flexibility and control desired.

The heating elements 102 provide an electrical heater that is divided in zones, such as zones Z1-Z3, to reduce electrical power required to heat the PM filter 104 and to provide selective heating of particular portions of the PM filter 104. By heating only the selected portions of the PM filter 104, the magnitude of forces in a substrate of the PM filter 104 is reduced due to thermal expansion. As a result, higher localized soot temperatures may be used during regeneration without damaging the PM filter 104.

The PM filter 104 may be catalyzed. The heated soot and exhaust gas causes PM in the PM filter 104 to burn, which regenerates the PM filter 104. The heating elements 35 generate a magnetic field, which creates Eddy currents within the soot. Resistance of the soot to the Eddy currents causes heating of the soot. The soot temperature increases until a critical temperature at which the soot ignites. The ignition of the soot creates an exotherm that propagates in the flow direction of the exhaust axially along the PM filter 104. When the soot in the PM filter 104 reaches a sufficiently high temperature, the associated heating element(s) may be turned off. Combustion of soot then cascades down the PM filter 104 without requiring power to be maintained to the electrical heater.

Figure 3B:
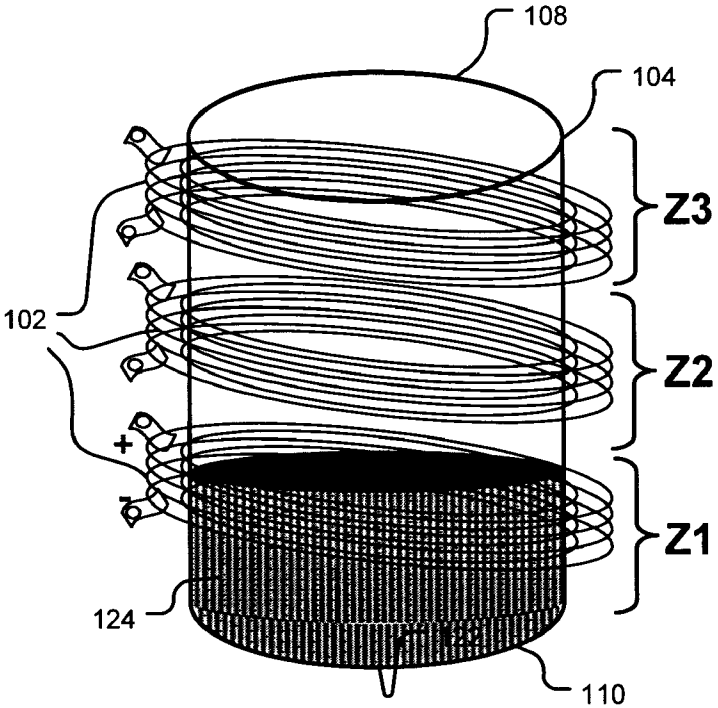
FIG. 3B is a perspective view of the zoned PM filter assembly of FIG. 2 illustrating exothermic propagation as a result of activating the output heating element.
Figure 3A:
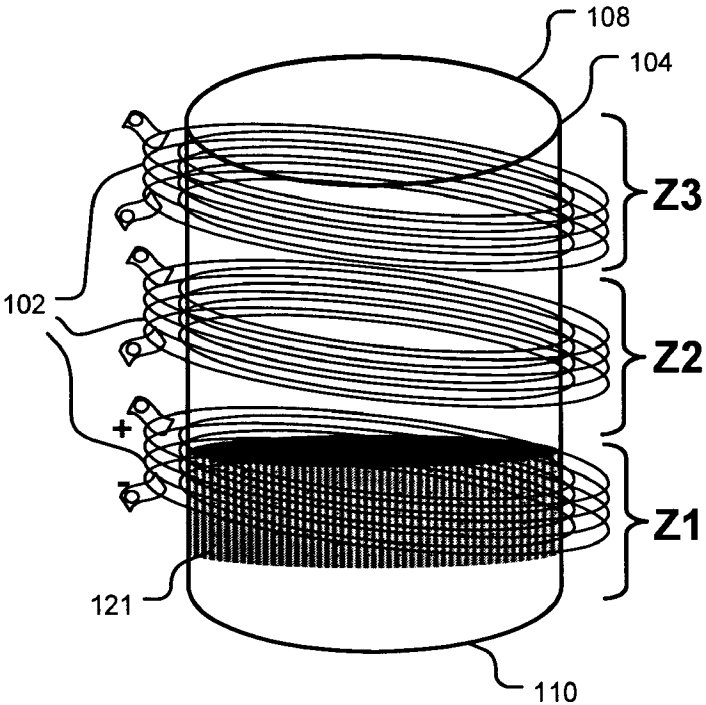
FIG. 3A is a perspective view of the zoned PM filter assembly of FIG. 2 illustrating activation of an output heating element in accordance with an embodiment of the present disclosure.
Figure 3C:
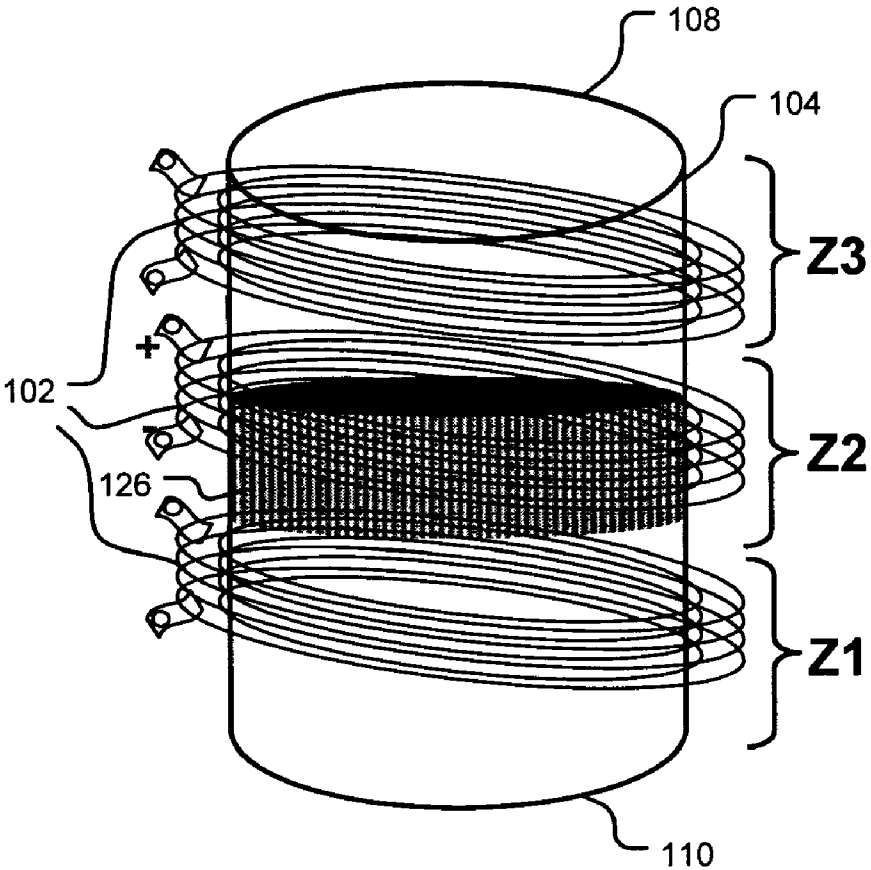
FIG. 3C is a perspective view of the zoned PM filter assembly of FIG. 2 illustrating activation of another heating element in accordance with an embodiment of the present disclosure.

Referring now to FIGS. 3A-3C, perspective views of the zoned PM filter 104 illustrating some example regeneration process steps are shown. Zones of the PM filter 104 may be regenerated sequentially starting with the zone closest to the output 110 of the PM filter (zone 1). This limits the amount of PM filter regeneration during each regeneration period. In FIG. 3A, the heating element closest to the output 110 and associated with zone 1 is activated. Volume of the PM filter 104 surrounded by the heating element, such as heating element 120, is the primary region where heating and light off of the soot occurs. The volume is represented by shaded area 121. The exotherm of this event coupled with the exhaust flow continues the regeneration towards the outlet 110 and bottom face 122 of the PM filter 104, which increases the effective volume of the regeneration zone, as shown in FIG. 3B. This is shown by shaded area 124.

FIG. 3C illustrates inductive heating of zone 2, which is performed subsequent to inductive heating of zone 1. The inductive heating of zone 2 includes similar regeneration characteristics as that of zone 1 until the associated exotherm reaches the previously cleaned region of zone 1. The heating of zone 2 is shown by shaded area 126. This process may continue for zone 3.

The PM filter 104 may have a predetermined peak operating temperature. The peak operating temperature may be associated with a point of potential PM filter degradation. For example, a PM filter may begin to breakdown at operating temperatures greater than 800° C. The peak operating temperature may vary for different PM filters. The peak operating temperature may be associated with an average temperature of a portion of the PM filter or an average temperature of the PM filter as a whole.

To prevent damaging the PM filter 104, and thus to increase the operating life of the PM filter 104, the embodiments of the present disclosure may adjust PM filter regeneration based on soot loading. A target maximum operating temperature $T_M$ is set for a PM filter. The target maximum operating temperature $T_M$ may correspond with a breakdown temperature of the PM filter. In one embodiment, the target maximum operating temperature $T_M$ is equal to the breakdown temperature multiple by a safety factor, such as 95%±2%. This safety factor is provided as an example only; other safety factors may be used.

Regeneration is performed when soot loading is less than or equal to a soot loading level associated with the maximum operating temperature $T_M$. The regeneration may be performed when soot loading levels are low or within a predetermined range. The predetermined range has a lower soot loading threshold $S_{lt}$ and an upper soot loading threshold $S_{ut}$ that is associated with the maximum operating temperature $T_M$. Limiting peak operating temperatures of a PM filter, minimizes pressures in and expansion of the PM filter. In one embodiment, soot loading is estimated and regeneration is performed based thereon. In another embodiment, when soot loading is greater than desired for regeneration, mitigation strategies are performed to reduce PM filter peak temperatures during regeneration.

Soot loading may be estimated from parameters, such as mileage, exhaust pressure, exhaust drop off pressure across a PM filter, by a predictive method, etc. Mileage refers to vehicle mileage, which approximately corresponds to or can be used to estimate vehicle engine operating time and/or the amount of exhaust gas generated. As an example, regeneration may be performed when a vehicle has traveled approximately 200-300 miles. The amount of soot generated depends upon vehicle operation over time. At idle speeds less soot is generated than when operating at travel speeds. The amount of exhaust gas generated is related to the state of soot loading in the PM filter.

Exhaust pressure can be used to estimate the amount of exhaust generated over a period of time. When an exhaust pressure exceeds a predetermined level or when an exhaust pressure decreases below a predetermined level, regeneration may be performed. For example when exhaust pressure entering a PM filter exceeds a predetermined level, regeneration may be performed. As another example when exhaust pressure exiting a PM filter is below a predetermined level, regeneration may be performed.

Exhaust drop off pressure may be used to estimate the amount of soot in a PM filter. For example, as the drop off pressure increases the amount of soot loading increases. The exhaust drop off pressure may be determined by determining pressure of exhaust entering a PM filter minus pressure of exhaust exiting the PM filter. Exhaust system pressure sensors may be used to provide these pressures.

A predictive method may include the determination of one or more engine operating conditions, such as engine load, fueling schemes, fuel injection timing, and exhaust gas recirculation (EGR). A cumulative weighting factor may be used based on the engine conditions. The cumulative weighting factor is related to soot loading. When the cumulative weighting factor exceeds a threshold, regeneration may be performed.

Based on the estimated soot loading and a known peak operating temperature for the PM filter 104, regeneration is performed to prevent the PM filter 104 from operating at temperatures above the peak operating temperature.

Designing a control system to target a selected soot loading allows PM filter regenerations without intrusive controls. A robust regeneration strategy as provided herein, removes soot from a PM filter, while limiting peak operating temperatures. Limiting of peak operating temperatures reduces thermal stresses on a substrate of a PM filter and thus prevents damage to the PM filter, which can be caused by high soot exotherms. Durability of the PM filter is increased.

When soot loading is greater than a threshold level associated with a set peak regeneration temperature, mitigation strategies may be performed to reduce PM filter peak temperatures during regeneration. For example, when a maximum soot loading threshold is set at approximately 2 g/l and current soot loading is 4 g/l, to minimize temperatures within a PM filter during regeneration engine operation is adjusted. The adjustment may include oxygen control and exhaust flow control.

Soot loading may be greater than an upper threshold level, for example, when an engine is operated to receive a high intake air flow rate for an extended period of time. Such operation may occur on a long freeway entrance ramp or during acceleration on a freeway. As another example, a soot loading upper threshold may be exceeded when throttle of an engine is continuously actuated between full ON and full OFF for an extended period of time. High air flow rates can prevent or limit regeneration of a PM filter.

During oxygen control, the amount of oxygen entering the PM filter is decreased to decrease the exotherm temperatures of the PM filter during regeneration. To decrease oxygen levels airflow may be decreased, EGR may be increased, and/or fuel injection may be increased. The fuel injection may be increased within engine cylinders and/or into the associated exhaust system. The burning of more fuel decreases the amount of oxygen present in the exhaust system.

A large increase in exhaust flow can aid in distinguishing or minimizing an exothermic reaction in a PM filter. Exhaust flow control may include an increase in exhaust flow by a downshift in a transmission or by an increase in idle speed. The increase in engine speed increases the amount of exhaust flow.

Figure 4:
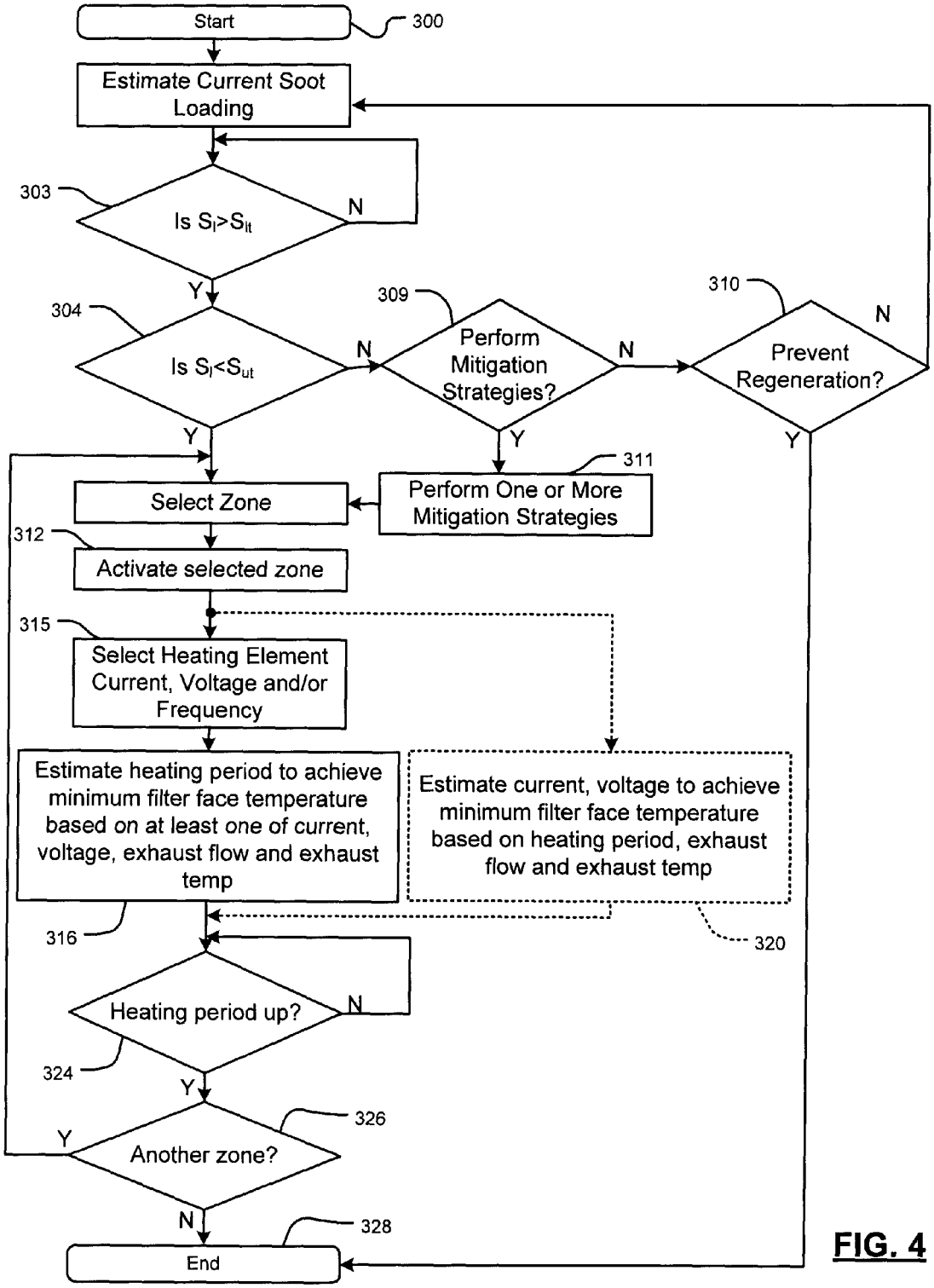
FIG. 4 is a flowchart illustrating steps performed by the control module to regenerate a zoned PM filter that has inductive heating elements in accordance with an embodiment of the present disclosure.

Although the following steps are primarily described with respect to the embodiments of FIGS. 1-3, the steps may be easily modified to apply to other embodiments of the present invention Referring now to FIG. 4, steps for regenerating a PM filter are shown. In step 300, control of a control module, such as the control module 44, begins and proceeds to step 301. In step 301, sensor signals are generated. The sensor signals may include an exhaust flow signal, an exhaust temperature signal, exhaust pressure signal, oxygen signal, intake air flow signal, intake air pressure signal, intake air temperature signal, engine speed signal, an EGR signal, etc., which may be generated by the above-described sensors.

In step 302, control estimates current soot loading $S_l$ of the PM filter. Control may estimate soot loading as described above. The estimation may be based on vehicle mileage, exhaust pressure, exhaust drop off pressure across the PM filter, and/or a predictive method. The predictive method may include estimation based on one or more engine operating parameters, such as engine load, fueling schemes, fuel injection timing, and EGR. In step 303, control determines whether the current soot loading $S_l$ is greater than a soot loading lower threshold $S_{lt}$. When the current soot loading $S_l$ is greater than the lower threshold $S_{lt}$ control proceeds to step 304, otherwise control returns to step 302.

In step 304, control determines whether current soot loading $S_l$ is less than a soot loading upper threshold $S_{ut}$. The upper threshold $S_{ut}$ may correspond with a set PM maximum operating temperature, such as the maximum operating temperature $T_M$. When the current soot loading $S_l$ is less than the upper threshold $S_{ut}$ then control proceeds to step 308. When the current soot loading $S_l$ is greater than or equal to the upper threshold $S_{ut}$ then control proceeds to step 310.

In steps 309 and 310, control determines whether to prevent or limit regeneration. Control may prevent regeneration, prevent regeneration for a predetermined time period, and/or perform mitigation strategies as described above to limit peak temperatures in the PM filter during regeneration. When regeneration is prevented, control may end at Step 328. When regeneration is prevented for a predetermined time period, control may return to step 302, 303, or proceed to step 311. Control may prevent regeneration when mitigation strategies can not be performed or when mitigation strategies are incapable of preventing and/or limiting the peak temperature of the PM filter from exceeding a predetermined threshold. The threshold may be the upper threshold $S_{ut}$.

In step 311, control performs mitigation strategies. Step 311 may be performed while performing regeneration steps 312-324. Control proceeds to step 308 before, during or after performing step 311.

If control determines that regeneration is needed in step 304, control selects one or more zones in step 308 and activates one or more heating elements for inductive heating of the selected zone(s) in step 312. Inductive heating refers to heating an electrically conductive or magnetic object by electromagnetic induction, where eddy currents are generated within the material and resistance leads to Joule heating of the material. There is a relationship between the frequency of the alternating current and the depth to which it penetrates in the material. Low frequencies of approximately 5-30 KHz are effective for thicker materials, since they provide deep heat penetration. Higher frequencies of approximately 100-400 KHz are effective for small particles or shallow penetration, such as diesel particulates.

The PM filter is regenerated by selectively heating one or more of the zones in the PM filter and igniting the soot using inductive heating. When soot within the selected zones reaches a regeneration temperature, the associated heating elements are turned off and the burning soot then cascades down the PM filter, which is similar to a burning fuse on a firework. In other words, the heating elements may be activated only long enough to start the soot ignition and is then shut off. Other regeneration systems typically use both conduction and/or convection and maintain power to the heater (at lower temperatures such as 600 degrees Celsius) throughout the soot burning process. As a result, these systems tend to use more power than the system proposed in the present disclosure.

In one embodiment, the zone closest to the outlet of the PM filter is regenerated first followed by the next nearest zone. The zones may be regenerated in a sequential, one at a time, independent fashion. In another embodiment, multiple zones are selected and heated during the same time period.

In step 315, control determines current, voltage and/or frequency to be applied to the selected heating elements. The current, voltage and/or frequency may be predetermined and stored in a memory, determined via a look-up table, or determined based on engine operating parameters, some of which are stated herein.

In step 316, control estimates a heating period sufficient to achieve a minimum soot temperature based on at least one of current, voltage, exhaust flow and exhaust temperature. The minimum soot temperature should be sufficient to start the soot burning and to create a cascade effect. For example only, the minimum soot temperature may be set to 700 degrees Celsius or greater. In an alternate step 320 to step 316, control estimates current and voltage needed to achieve minimum soot temperatures based on a predetermined heating period, exhaust flow and exhaust temperature.

In step 324, control determines whether the heating period is up. If step 324 is true, control determines whether additional zones need to be regenerated in step 326. If step 326 is true, control returns to step 308.

The burning soot is the fuel that continues the regeneration. This process is continued for each heating zone until the PM filter is completely regenerated. Control ends in step 328.

The above-described steps are meant to be illustrative examples; the steps may be performed sequentially, synchronously, simultaneously, continuously, during overlapping time periods or in a different order depending upon the application.

The above described method provides inductive heating of zones of a PM filter while reducing spontaneous power consumption in the PM filter and thus improves robustness and life of the PM filter.

In use, the control module determines when the PM filter requires regeneration. The determination is based on soot levels within the PM filter. Alternately, regeneration can be performed periodically or on an event basis. The control module may estimate when the entire PM filter needs regeneration or when zones within the PM filter need regeneration. When the control module determines that the entire PM filter needs regeneration, the control module sequentially activates one or more of the zones at a time to initiate regeneration within the associated downstream portion of the PM filter. After the zone or zones are regenerated, one or more other zones are activated while the others are deactivated. This approach continues until all of the zones have been activated. When the control module determines that one of the zones needs regeneration, the control module activates the zone corresponding to the associated downstream portion of the PM filter needing regeneration.

The present disclosure provides a low power regeneration technique with short regeneration periods and thus overall regeneration time of a PM filter. The present disclosure may substantially reduce the fuel economy penalty, decrease tailpipe temperatures, and improve system robustness due to the smaller regeneration time. The embodiments provide PM heating without the use of a susceptor or introduction of a material to absorb conductive heating. Resistance of the soot within a PM filter provides the internal heating to start a regeneration process.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system comprising: a particulate matter (PM) filter comprises an upstream end for receiving exhaust gas, a downstream end and a plurality of zones; a plurality of heating elements, wherein each of said plurality of heating elements surrounding a respective one of said plurality of zones; and a control module that selectively activates a first one of said plurality of heating elements to inductively heat a first one of said plurality of zones, wherein said first one of said plurality of heating elements is closer to said downstream end than other ones of said plurality of heating elements, wherein said control module heats and regenerates said first one of said plurality of heating elements prior to heating and regenerating said other ones of said plurality of heating elements, wherein said control module sequentially activates said plurality of heating elements from said downstream end to said upstream end to regenerate said PM filter, wherein said control module is configured to determine at least one engine operating parameter and adjusts a frequency of current applied to said plurality of heating elements based on said at least one engine operating parameter; and wherein said at least one engine operating parameter comprises an engine load, a fuel injection timing value, and an exhaust gas recirculation value.

2. The system of claim 1 wherein said first one of said plurality of heating elements generates a magnetic field, and wherein particulate matter in said first one of said plurality of zones increases in temperature based on said magnetic field.

3. The system of claim 1 wherein said control module selects at least one of current and voltage to apply to said first one of said plurality of heating elements.

4. The system of claim 1 wherein said control module selects frequency of current applied to said first one of said plurality of heating elements.

5. The system of claim 4 wherein said frequency is approximately between 50 KHz-450 KHz.

6. A method comprising:

receiving an exhaust gas via a particulate matter (PM) filter that has an upstream end, a downstream end and a plurality of zones;

selectively activating a first one of a plurality of heating elements to inductively heat a first one of said plurality of zones;

sequentially activating said plurality of heating elements from said downstream end to said upstream end to regenerate said PM filter, wherein each of said plurality of heating elements surrounds a respective one of said plurality of zones, wherein said first one of said plurality of heating elements is closer to said downstream end than other ones of said plurality of heating elements, and wherein said first one of said plurality of heating elements is heated and regenerated prior to heating and regenerating said other ones of said plurality of heating elements; and adjusting a frequency of current applied to said plurality of heating elements based on a plurality of engine operating parameters, wherein said plurality of engine operating parameters comprises an engine load, a fuel injection timing value, and an exhaust gas recirculation value.

7. The method of claim 6 comprising activating said plurality of heating elements axially along said PM filter.

8. The method of claim 6 comprising activating said plurality of heating elements one at a time.

9. The method of claim 6 comprising:

generating a first heating element signal to regenerate said first one of said plurality of zones; and generating a second heating element signal to regenerate a second one of said plurality of zones after regeneration of said first one of said plurality of zones.

10. The method of claim 9 wherein said first one of said plurality of zones is downstream from said second one of said plurality of zones.

11. The system of claim 1 wherein:

said control module heats and regenerates a second one of said plurality of heating elements subsequent to heating and regenerating said first one of said plurality of heating elements; and said second one of said plurality of heating elements is closer to said first one of said plurality of heating elements than others of said plurality of heating elements.

12. The system of claim 1 wherein:

said plurality of heating elements comprises N heating elements sequentially arranged along said PM filter from said downstream end to said upstream end, where N is an integer greater than 2; and said control module sequentially regenerates zones of said PM filter from said downstream end to said upstream end by heating said plurality of heating elements beginning with said first one of said plurality of heating elements and ending with said $N^{th}$ one of said plurality of heating elements, wherein said $N^{th}$ one of said plurality of heating elements is closer to said upstream end than others of said plurality of heating elements.

13. The system of claim 1 wherein said control module completes regeneration of said first one of said plurality of heating elements prior to regenerating said other ones of said plurality of heating elements.

14. The system of claim 1 wherein said at least one engine operating parameter comprises a fueling scheme.

15. The system of claim 1 wherein said control module adjusts the frequency of the current applied to said plurality of heating elements based on at least one of:

a penetration depth of electromagnetically induced current in said PM filter; and a material thickness of said PM filter.

16. The system of claim 1 wherein:

each of said plurality of heating elements when activated has an associated regeneration period; and said control module deactivates said plurality of heating elements between said regeneration periods of said plurality of heating elements to provide non-regeneration periods between pairs of said regeneration periods to cool said PM filter.

17. The system of claim 1 wherein:

each of said plurality of heating elements when activated has a respective regeneration period; and said regeneration periods of said plurality of heating elements occur consecutively without non-regeneration periods between pairs of said regeneration periods.

18. The system of claim 12 wherein:

said plurality of zones include N zones;

said control module regenerates each of said N zones that is upstream from said first one of said N zones subsequent to regenerating zones of the PM filter downstream from said each of said N zones to prevent an average temperature of said PM filter from exceeding a maximum operating temperature of said PM filter; and during regeneration of said each of said N zones, said zones of said PM filter that are downstream from said each of said N zones prevent propagation of an exotherm from said each of said N zones to said downstream end of said PM filter.

19. A system comprising: a particulate matter (PM) filter comprises an upstream end for receiving exhaust gas, a downstream end and N zones, where N is an integer greater than 2; N heating elements, sequentially arranged along said PM filter from said downstream end to said upstream end, wherein said Nth one of said N heating elements is closer to said upstream end than others of said N heating elements; and a control module configured to activate a first one of said N heating elements to inductively heat a first one of said N zones at said downstream end, sequentially regenerate said N zones from said downstream end to said upstream end by heating said N heating elements beginning with said first one of said N heating elements and ending with said Nth one of said N heating elements, and regenerate each of said N zones that is upstream from said first one of said N zones subsequent to regenerating zones of the PM filter downstream from said each of said N zones to prevent an average temperature of said PM filter from exceeding a maximum operating temperature of said PM filter, wherein during regeneration of said each of said N zones, said zones of said PM filter that are downstream from said each of said N zones prevent propagation of an exotherm from said each of said N zones to said downstream end of said PM filter, wherein said control module is configured to determine at least one of a penetration depth of electromagnetically induced current in said PM filter and a material thickness of said PM filter, and wherein said control module is configured to adjust frequency of current applied to said N heating elements based on at least one of: said penetration depth of said electromagnetically induced current in said PM filter and said material thickness of said PM filter.

* * * * *